United States Patent [19]

Miyata

[11] 3,978,303

[45] Aug. 31, 1976

[54] LEAF SPRING SWITCH

[75] Inventor: Muneyoshi Miyata, Tokyo, Japan

[73] Assignee: Mitsuku Denshi Kogyo K.K., Tokyo, Japan

[22] Filed: Oct. 24, 1974

[21] Appl. No.: 517,674

[30] Foreign Application Priority Data

Oct. 29, 1973 Japan ..... 48-125229[U]
July 2, 1974 Japan ..... 49-78115[U]

[52] U.S. Cl. ..... 200/283; 200/1 A; 200/246

[51] Int. Cl.[2] ..... H01H 1/26

[58] Field of Search ..... 200/283, 246, 1 A

[56] References Cited

UNITED STATES PATENTS

| | | | |
|---|---|---|---|
| 3,099,735 | 7/1963 | Roeser | 200/283 X |
| 3,126,466 | 3/1964 | Schwartz | 200/283 |

*Primary Examiner*—Herman Hohauser
*Attorney, Agent, or Firm*—Frank J. Jordan

[57] ABSTRACT

A switch comprising a pair of leaf springs having contacts and terminals at the both ends thereof, a base member supporting the leaf springs in a cantilever fashion in superposed relationship and a fulcrum member supporting one of the leaf springs so as to make the leaf spring moveable downwardly by pushing the end of the leaf spring.

2 Claims, 6 Drawing Figures

LEAF SPRING SWITCH

BACKGROUND OF THE INVENTION

1. Field of the Invention

This invention relates generally to a switch and more particularly to new and useful improvements in a switch adapted for use in various electric and electronics appliances.

2. Description of the Prior Art

Switches consisting of a pair of elongated leaf springs having contacts at the ends thereof are well known and widely used in various types of relays. The leaf springs of these switches are generally supported at a base in a cantilever fashion in spaced and parallel relationship, and provided with the contacts and terminals at the both ends thereof.

Conventionally, in switches of this kind, the contacts of the switches are liable to be erroneously contacted by vibration, shock and oscillation exerted from outside, because the leaf springs are extended from the base at at considerable length in a cantilever fashion and clearance between the contacts at the ends of the leaf springs is narrow. Also, lead wires are somewhat difficult to be connected to the terminals, because the terminals are extended from the base in the one direction superposing one over another.

SUMMARY OF THE INVENTION

Accordingly, it is an object of the present invention to provide a switch which is able to make switching on and off operation quickly and repeatedly by pushing the end of moving contact of the switch with a manual or electromagnetic force.

Another object of the present invention is to provide a switch which is stable and reliable in its operation eliminating an accidental contact of switching elements by vibration, shock or impact exerted to the switch from outside.

Still another object of the present invention is to provide a switch which is able to easily connect lead wires to lead terminals of the switch, thus the working efficiency thereof can be greatly increased.

Briefly, the foregoing and other objects, features and advantages are attained in accordance with the present invention by the provision of a switch including a pair of leaf springs which are embeded in a base in a cantilever fashion so as to lie one over another having a space therebetween. The leaf springs extended from the base include contacts at one ends thereof and terminals at another ends thereof, which are bifurcated to direct in opposite directions so that the overlap of the terminals may be eliminated. In addition, the leaf springs are supported by a fulcrum member at the midway of the springs, which may be made as a separate member or integrally with the base, so that the moving contact of the switch may be pushed downwardly like a lever.

BRIEF DESCRIPTION OF THE DRAWINGS

Various other objects, features and attendant advantages of the present invention will be more fully appreciated as the same becomes better understood by reference to the following detailed description when considered in connection with the accompanying drawings, wherein like reference numerals designate like or corresponding parts throughout the several views and in which.

DESCRIPTION OF THE PREFERRED EMBODIMENTS

Figure 1:
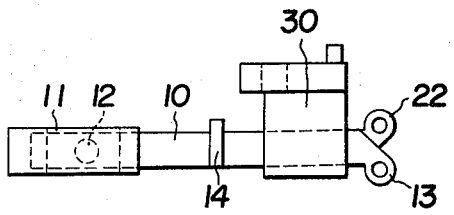
FIG. 1 is a top plan view of a switch in accordance with the present invention.
Figure 2:
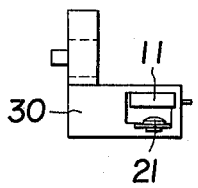
FIG. 2 is a left side elevational view of a switch in accordance with the present invention.
Figure 3:
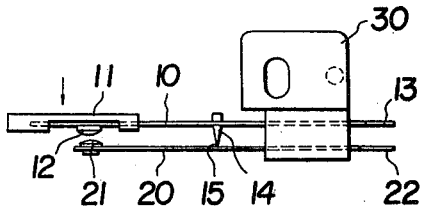
FIG. 3 is a front elevational view of a switch in accordance with the present invention.
Figure 4:
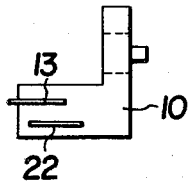
FIG. 4 is a right side elevational view of a switch in accordance with the present invention.
Figure 5:
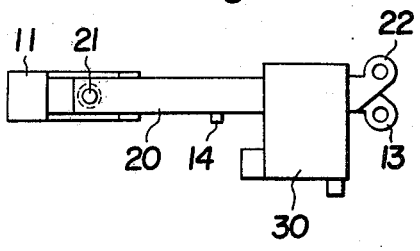
FIG. 5 is a bottom plan view of a switch in accordance with the present invention.
Figure 6:
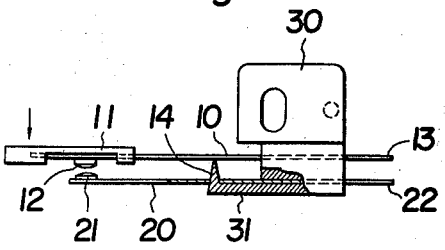
FIG. 6 is a front elevational view of a switch in accordance with another embodiment of the present invention.

Referring now to the drawings and more particularly to FIGS. 1 to 5 thereof, a switch is shown as including a pair of leaf springs 10 and 20 embeded in an insulating base member 30 in parallel and superposed relationship with each other maintaining a space therebetween. The leaf spring 10 acts as a moving contact of the switch and includes a lug 11 made of an insulating material on the upper end surface of the leaf spring 10, a contact 12 on the reverse side of the leaf spring 10 and a terminal 13 at other end of the leaf spring 10, which is projected in a side direction as shown in FIGS. 1 and 5. In the same manner, the leaf spring 20 includes a contact 21 on the upper end surface of the spring 20 which faces the contact 12 and forms a contact separation between the contacts 12 and 21 and a terminal 22 which is projected in the opposite direction of the terminal 13 as shown in FIGS. 1, 3 and 5.

As is apparent from FIG. 3, the switch according to the present invention includes a fulcrum member 14 made of an insulating material which is secured to the leaf sping 10 at a point slightly approaching to the base member 30 between the contact 11 and the base member 30 and is contacted with the leaf spring 20 by a tip 15 of the fulcrum member 14. The fulcrum member 14 may be made as an independant element shown in FIGS. 1 to 5, or it may be made integrally with the base member 30 as shown in FIG. 8.

In the embodiment shown in FIG. 8, the base member 30 includes an extension 31, from the end of which the fulcrum 14 is projected upwardly, and the leaf spring 20 is embeded in the base and the root of the fulcrum 14 as well.

The switch according to the present invention is incorporated in an electronics appliance by fixing the base member 30 to the inside of the appliance so that the lug 11 provided at the end of the leaf spring 10 may be pushed by a rod or cam associated with the appliance. When the lug 11 is pushed, the leaf spring 10 is elastically bent at the fulcrum 14 so as to make the contact 12 connect to the contact 21. When the pushing is released, the contact 12 and the leaf spring 10 return to the original position and the electrical circuit is disconnected. According to the present invention, the distance between the leaf springs 10 and 20 is always kept constant and the restitution power of the leaf spring 10 is strengthened by the provision of the fulcrum member 14. Also, the fulcrum member 14 restricts the vibratory motion of the leaf springs 10 and 20 due to the external forces. Thus, the miscontact of the contacts 12 and 21 can be prevented and the reliable switching on and off operation can be achieved.

Obviously, many modifications and variations of the present invention are possible in light of the above teachings. It is therefore to be understood that within the scope of the appended claims, the invention may be practices otherwise than as specifically described.

What is claimed as new and desired to be secured by Letters Patent of the United States is:

1. A switch comprising an insulating base member, a first leaf spring having a lug on one longitudinal end, said lug being adapted to be engaged by an actuator, said first leaf spring also having a first contact on said one longitudinal end, said first leaf spring further having a terminal on the other longitudinal end, a second leaf spring having a second contact on one longitudinal end and a terminal at the other longitudinal end, said first and second leaf springs being embedded in said base member in cantilever fashion in a spaced and generally parallel relationship such that said first and second contacts oppose one another in spaced relationship, said lug being adapted to be engaged by said actuator to move said first leaf spring toward said second leaf spring to thereby move said first contact into engagement with said second contact, and an insulating fulcrum member secured to said first leaf spring at a location intermediate said first contact and said base member, said insulating fulcrum member projecting towards said second leaf spring and engaging said second leaf spring at a location intermediate said second contact and said base means to thereby maintain a constant distance between said intermediate locations of said first and second leaf springs, thereby increasing the restitution power of said first leaf spring.

2. A switch comprising an insulating base member, a first leaf spring having a lug on one longitudinal end, said lug being adapted to be engaged by an actuator, said first leaf spring also having a first contact on said one longitudinal end, said first leaf spring further having a terminal on the other longitudinal end, a second leaf spring having a second contact on one longitudinal end and a terminal at the other longitudinal end, said first and second leaf springs being embedded in said base member in cantilever fashion in a spaced and generally parallel relationship such that said first and second contacts oppose one another in spaced relationship, said lug being adapted to be engaged by said actuator to move said first leaf spring toward said second leaf spring to thereby move said first contact into engagement with said second contact, said base means having an integral insulating fulcrum member, said insulating fulcrum member having a first portion projecting laterally from said base member and extending generally parallel to said first and second leaf springs, said insulating fulcrum member having a second portion extending generally perpendicular from said first portion, said second portion projecting toward said first leaf spring and engaging said first leaf spring at a location intermediate said first contact and said base member to thereby provide a fulcrum for said first leaf spring at said intermediate location, thereby increasing the restitution power of said first leaf spring.

* * * * *